US006273743B1

(12) United States Patent
Wakahara et al.

(10) Patent No.: US 6,273,743 B1
(45) Date of Patent: Aug. 14, 2001

(54) LATCH APPARATUS FOR ELECTRICAL CONNECTION

(75) Inventors: Hiroshi Wakahara, Ikoma; Teruyoshi Nishio, Neyagawa; Shuichi Konishi, Hirakata, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/358,542

(22) Filed: Jul. 22, 1999

(30) Foreign Application Priority Data

Jul. 30, 1998 (JP) ..... 10-214685
Sep. 2, 1998 (JP) ..... 10-247651

(51) Int. Cl.[7] ..... H01R 13/62
(52) U.S. Cl. ..... 439/372
(58) Field of Search ..... 439/345, 372, 439/373

(56) References Cited

U.S. PATENT DOCUMENTS 5,857,869 * 1/1999 Parcel et al. ..... 439/372

* cited by examiner

*Primary Examiner*—Neil Abrams
(74) *Attorney, Agent, or Firm*—Parkhurst & Wendel, L.L.P.

(57) ABSTRACT

A latch apparatus which prevents connectors from separating from each other is provided by means of a simplified configuration as compared to conventional latch springs. A curled latch spring has knuckles or bent portions that fit into grooves to secure connectors. A coiled latch spring has coil portions that fit into grooves in the plate of a mating connector. When the latch spring is turned around a spring leg holder, three-dimensional knuckle portions of the latch spring contact and engage a spring holder to hold the latch spring by the spring holder. A first connector on the computer side and a second connector on the cable side are connected and fastened only by the latch spring. Consequently, the first and second connectors can be easily and surely engaged and fastened only by the latch spring.

3 Claims, 8 Drawing Sheets

LATCH APPARATUS FOR ELECTRICAL CONNECTION

FIELD OF THE INVENTION

The present invention relates to latch apparatus to connect and fasten connectors on a computer and a terminal device, such as an external printer.

BACKGROUND OF THE INVENTION

Conventionally, for connecting, for example, a general computer system with an external printer or the like, latch apparatus have been widely used in connecting a connector which is a securing member provided for an input-output printer port on the computer side and a connector which is a securing member on the cable side. The latter connector is standardized in line with the former connector and connected to the external printer. The latch apparatus is utilized for fastening, or latching, the connector on the computer side and the connector on the cable side.

Such conventional latch apparatus include: an elastic body (spring); a freely turnable support member to support the elastic body; and a holding member (latching plate) to which a connector on the cable side is attached and which engages the elastic body, wherein the elastic body turns about its support portions which act as fulcrums, and the elastic body engages the holding member. The connector on the computer side and the connector on the cable side join so as to fasten the cable from the external printer to the printer port, so that the external printer or the like may be connected to the computer device.

The operation of the above mentioned conventional latch apparatus is described below.

FIGS. 7*a*, 7*b*, respectively, show a front view and a side view of the latch spring which is an elastic body in a conventional latch apparatus. FIG. 8*a*, FIG. 8*b*, and FIG. 8*c*, respectively, illustrate a top view, a front view and a side view of the engaging operation of the latch spring.

As shown in these prior art figures, a conventional latch spring 20 which is an elastic body is engaged by fitting spring legs 8 which are holding portions into axial holes 7 of a spring leg holder 2 which is a support member of the latch spring, and the spring leg holder 2 is fastened to a mounting base 3 by a screw 4. Alternatively, a spring holder 5 which is a holding member is fastened to a connector 10 on the cable side by a screw 9.

A second connector 10 is engaged with a first connector 11 of the mounting base 3 on the computer side, and at this moment, the conventional latch spring 20 is turned in the direction of the arrow Y50 around the spring leg holder 2, and the conventional latch spring 20 contacts and engages a holder groove 6 of the spring holder 5. Consequently, the first and second connector 11, 10 are engaged and connected. That is, the second connector 10 is prevented from slipping off the first connector 11 by holding the spring holder 5 by using spatially two-dimensional spring shoulders 21 in the conventional latch spring 20.

However, in the above mentioned conventional latch equipment, as shown in FIG. 7 and FIG. 8, the spring shoulder 21 in the conventional latch spring 20 to be engaged with the spring holder 5 has a two-dimensional shape, and therefore, in the case where a cable connected to the computer device is caught, the cable is pulled, and pressure is added to the second connector 10 on the cable side in the direction of being pulled out of the first connector 11 (direction shown by an arrow Y51). Accordingly, the shape of the conventional latch spring 20 may easily be deformed and the latching force is lost, posing the problem that the cable often slips off the computer device.

To solve this problem, first connector 11 on the computer side and the second connector 10 on the cable side are often fastened not by engagement of the conventional latch spring 20, but by a screw. However, this solution poses another problem. The operating performance for connection and removal of an external device like a printer worsens and the simple operation of removal and insertion of a cable becomes more difficult.

The present invention solves the above mentioned conventional problems, and provides a latch apparatus which can securely connect and fasten the connector on the spring holder side to the connector on the spring leg holder side, thereby preventing the connectors from slipping off and separating while offering a simple configuration as compared to a conventional latch spring.

SUMMARY OF THE INVENTION

To solve the above problem, a latch apparatus of a first embodiment of the present invention includes a pair of three-dimensional knuckle portions projected in the turning direction of an elastic body and formed in the elastic body. When the elastic body turns around a support member, the knuckle portions contact and engage a holding member. First and second securing members easily connect and securely fasten each other only by the elastic body. Since the holding member is held by the three-dimensional knuckle portions of the elastic body, the conventional latching force in a secondary surface near the engaging point is added with a latching force produced in the direction approximately perpendicular to a secondary plane. The secondary plane is defined by the relation of the relative shape between the shape of the knuckle and the shape of the holding member at its engaging point. As a result, the latching function for the holding member is remarkably strengthened. Consequently, a strong holding effect from the first securing member on the support member side can be exerted on the second securing member on the holding member side.

Furthermore, the latch apparatus of a second embodiment of the present invention is an apparatus in which a ring-like winding portion with one or more windings is formed in the elastic body, and when the elastic body turns around the support member, this winding portion contacts and engages the holding member. The first and second securing members easily connect and securely fastened each other only by means of the elastic body. The in-plane flexural rigidity of the winding portion is remarkably larger than that of a conventional shape, and therefore, the latching force is also stronger.

As mentioned above, although the configuration of the elastic body is relatively simple, the second securing member on the holding member side can securely connect and fasten the first securing member on the support member side, so that the second securing member resists slipping off and separating from the first securing member. Thereby providing improve functionality as compared with an elastic body (spring) having a conventional shape. As a result, the above latch apparatus can be used as a latch apparatus for a connector which is a securing member between various kinds of devices installed on an aircraft, a vehicle, or the like which is exposed to a lot of vibrations, enabling sure holding and fastening of the connector.

The latch apparatus of the first embodiment of the present invention is a latch apparatus which connects and fastens securing members in a computer system including a plurality of electronic devices, when connecting the respective devices through the securing members for effecting connection between the respective devices. The apparatus includes an elastic body in which a pair of three-dimensional knuckle portions are formed approximately linearly symmetrically and the knuckle portions are arranged approximately in accordance with the engaging positions of an engaging object and which is formed to be freely turnable in a state where both ends of the elastic body are supported; a support member having a first securing member to support the elastic body by engaging the support portions at both ends of the elastic body; and a holding member which is an engaging object of the elastic body and having a second securing member to bring the holding member into contact with and engagement with the knuckle portions of the elastic body to hold the elastic body. The elastic body turns around the support member, and the knuckle portions of the elastic body contact and engaged the holding member. The holding member holds the elastic body so that the first and second securing members may connect and fasten each other only by means of the elastic body.

According to this configuration, when the elastic body turns around the support member, the three-dimensional knuckle portions of the elastic body contact and engaged the holding member, thereby holding the elastic body by the holding member. The first and second securing members are connected and fastened to each other only by means of the elastic body. Hence, the first securing and second securing members may easily and securely engage and fasten only by means of the elastic body. Accordingly, the holding member holds the three-dimensional knuckle portions of the elastic body, and the three-dimensional knuckle portions of the elastic body have a latching function for the holding member. In this manner the holding effect is exerted on the second securing member to prevent its slipping off the first securing member.

Furthermore, the latch equipment of the second embodiment of the present invention is a latch apparatus which connects and fastens securing members in a computer system including a plurality of electronic devices, when connecting the respective devices through the securing members for effecting connection between the respective devices. The apparatus includes an elastic body in which a winding portion forms one or more windings. The winding portion is arranged approximately in accordance with an engaging position of an engaging object. The portion is formed to be freely turnable in a state where both ends are supported. A support member having a first securing member to support the elastic body by engaging support portions at both ends of the elastic body. And a holding member which is the engaging object of the elastic body and having a second securing member to contact the holding member and engage the winding portion of the elastic body to hold the elastic body. The elastic body turns around the support member and the winding portion of the elastic body contacts and engages the holding member to hold the elastic body by the holding member. In this manner, the first and second securing members may connect and fasten each other only by the elastic body.

According to this configuration, when the elastic body turns around the support member, the winding portion of the elastic body contacts and engages the holding member to hold the elastic body by the holding member. The first and second securing members connect and fasten only by means of the elastic body, so that the first and second securing members may easily and securely engage and fasten each other only by means of the elastic body. Accordingly, the holding member holds the winding portion of the elastic body, and the winding portion of the elastic body has a latching function for the holding member. In this manner, the holding effect of the winding portion is exerted on the second securing member to prevent slipping off the first securing member.

DETAILED DESCRIPTION

Figure 1:
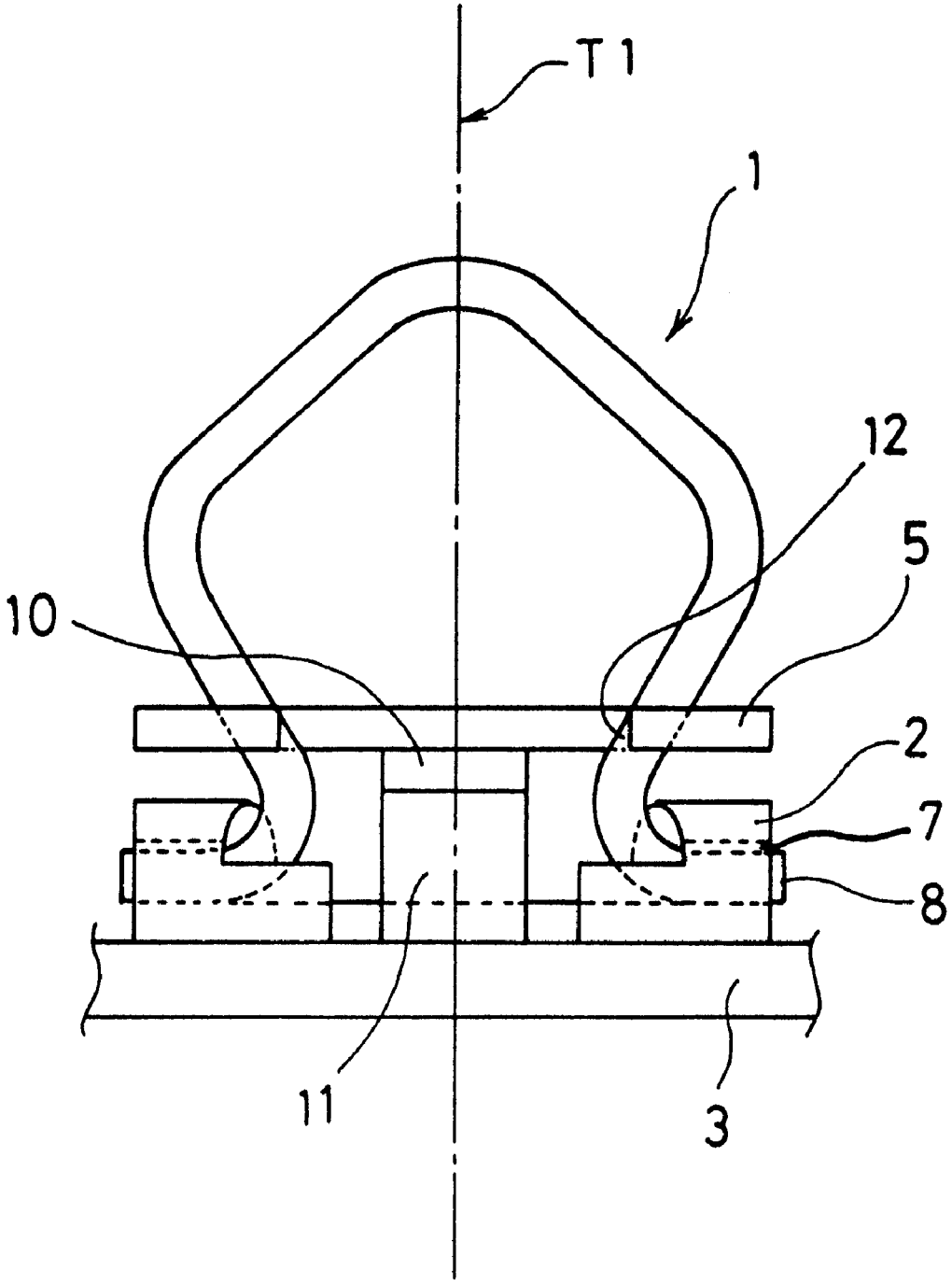
FIG. 1 is a front view showing the configuration of a latch 4 apparatus of Embodiment 1 of the present invention.

The latch apparatus showing the embodiments of the present invention is described below by referring to the drawings.

Embodiment 1

Figure 2:
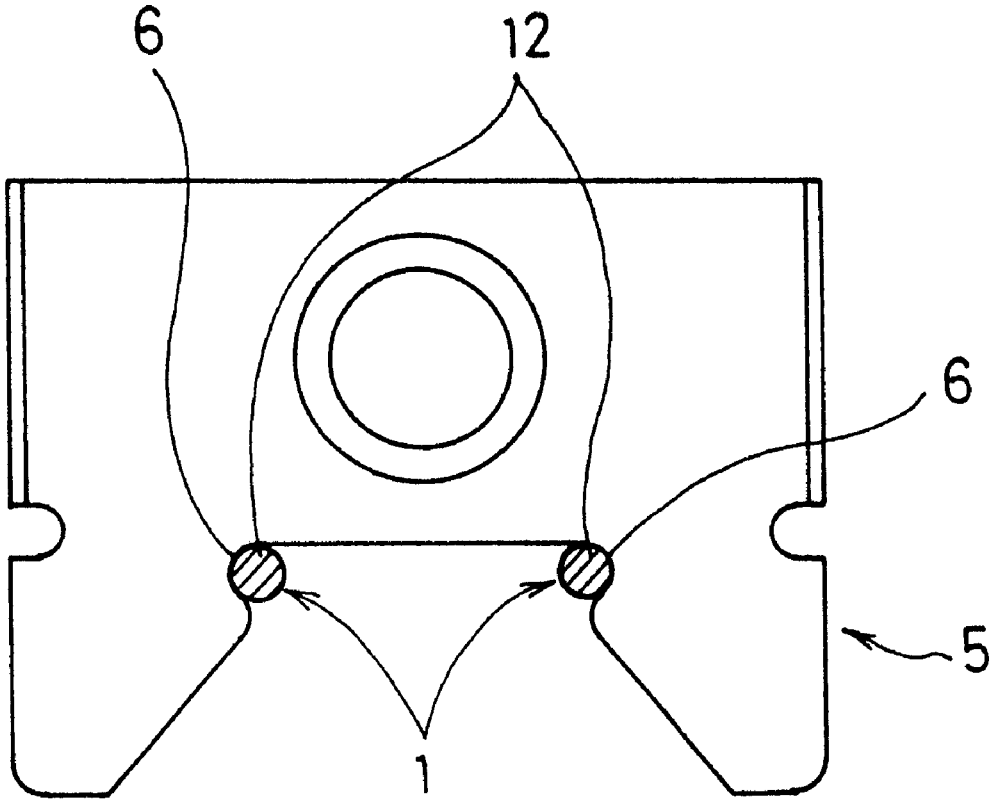
FIG. 2 is a top view showing the configuration of the latch apparatus of Embodiment 1 of the present invention.
Figure 3:
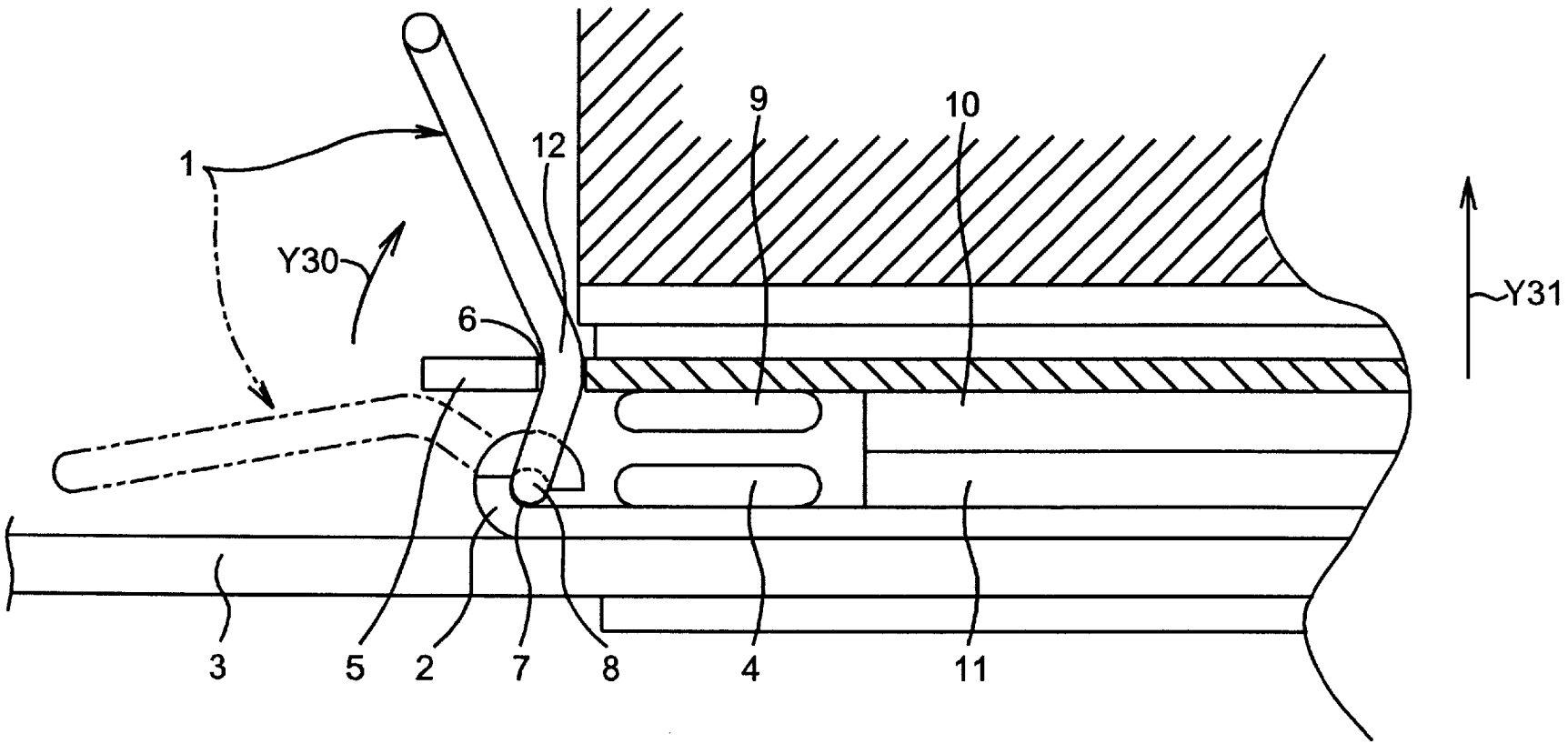
FIG. 3 is a side view showing the configuration of the latch apparatus of Embodiment 1 of the present invention.

FIG. 1 is a front view of a latch apparatus of the present Embodiment 1, and FIG. 2 is a top view in the present Embodiment 1, and FIG. 3 is a side view in the present Embodiment 1.

The latch apparatus of the present Embodiment 1 is configured such that for example, a second connector 10 on the cable side which is a second securing member connects and fastens a first connector 11 on the computer side which is a first securing member by using a curled latch spring 1 which is an elastic body as shown in FIG. 1, FIG. 2, and FIG. 3, in a computer system comprising a plurality of electronic devices such as a display monitor, a printer, or a hard disk, when performing connection between those respective devices through connectors which are securing members at both ends of cables for connecting those respective devices by cables.

Furthermore, as shown in each figure, an approximately Ω-shaped curled latch spring 1 is formed in such a way that a pair of spatially three-dimensional knuckle portion 12 is formed approximately linearly symmetrical with respect to the straight line Ti and they are arranged approximately in accordance with the position of an engaging object with which the knuckle portion 12 is engaged and the curled latch spring 1 is freely turnable in the state where both ends of the lower portion of the approximate Ω-shape are supported.

Furthermore, in FIGS. 1 and 3 a spring leg holder 2 is a support member to which a first connector 11 is provided and supports the curled latch spring 1 by pivotally engaging spring legs 8 as support portions of both ends thereof. A spring holder 5 is a holding member which is an engaging object of the curled latch spring 1 and to which a second connector 10 is provided. The spring holder 5 contacts and engages the knuckle portion 12 of the curled latch spring 1 to hold the curled latch spring 1.

If the curled latch spring 1 is turned in the direction shown by the arrow Y30 around the spring leg holder 2 and the knuckle portion 12 of the curled latch spring 1 contacts and engages with the spring holder 5 to hold the latch spring 1 by the spring holder 5, then the first and second connectors 11, 10 can be connected and fastened only by the curled latch spring 1.

The operation of this latch apparatus will now be described below.

Basically, the curled latch spring 1 is engaged by fitting the spring legs 8 into axial holes 7 of the spring leg holder 2, and the spring leg holder 2 is fastened to a mounting base 3 by a screw 4. Alternatively, the spring holder 5 is fastened to the second connector 10 by a screw 9.

The second connector 10 engages the first connector 11 of the mounting base 3, and at this moment, the curled latch spring 1 is turned in the direction shown by the arrow Y30 around the spring leg holder 2, and the curled latch spring 1 contacts and engages a holder groove 6 of the spring holder 5. Consequently, the connection and engagement between the first and second connectors 11, 10 are made sure. The second connector 10 is prevented from slipping off the first connector 11 by holding the spring holder 5 by the three-dimensional knuckle portion 12 of the curled latch spring 1.

As mentioned above, when the curled latch spring 1 is turned around the spring leg holder 2, the three-dimensional knuckle portion 12 of the curled latch spring 1 contacts and engages the spring holder 5, and the latch spring 1 is held by the spring holder 5, and the first connector 11 on the computer side and the second connector 10 on the cable side are connected and fastened only by the curled latch spring 1, and consequently, the first and second connectors 11, 10 can easily and surely be engaged and fastened only by the curled latch spring 1.

Accordingly, the spring holder 5 can hold the three-dimensional knuckle portion 12 of the curled latch spring 1. The latching function of the three-dimensional knuckle portion 12 of the curled latch spring 1. The holding effect in the direction of slipping off from the first connector 11 (direction shown by the arrow Y31) can also be obtained for the second connector 10.

Therefore, the second connector 10 on the spring holder 5 side (cable side) can surely be connected and fastened to the first connector 11 on the spring leg holder 2 side (computer side), and it can be made impossible for the first and second connectors 11, 10 to easily slip off between them. A simple configuration makes separation difficult.

Embodiment 2

Figure 4:
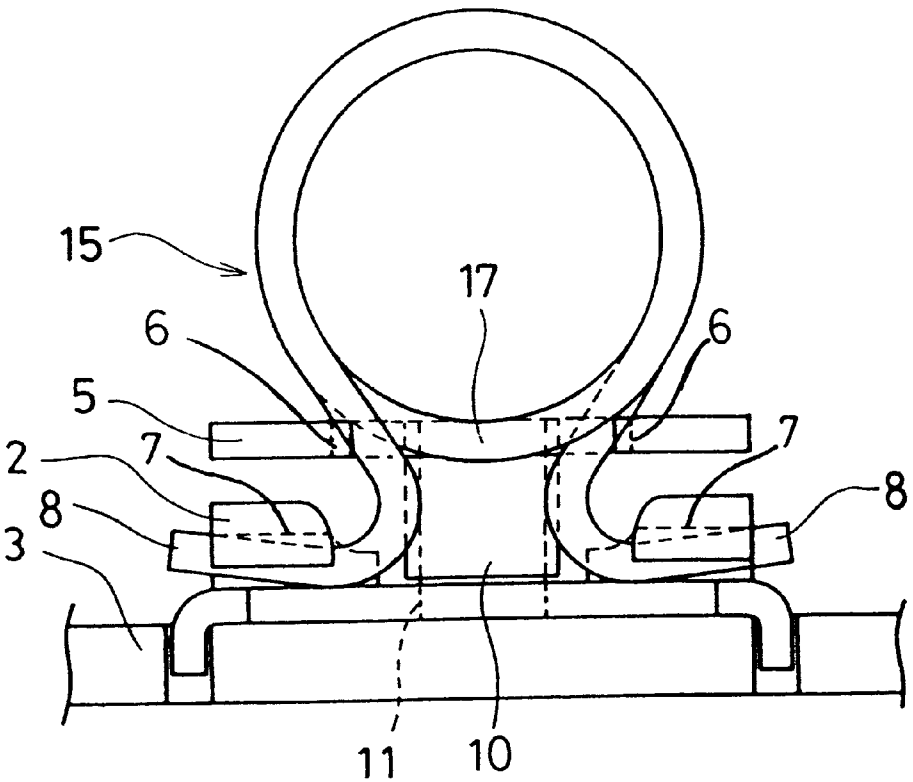
FIG. 4 is a front view showing the configuration of a latch apparatus of Embodiment 2 of the present invention.
Figure 5:
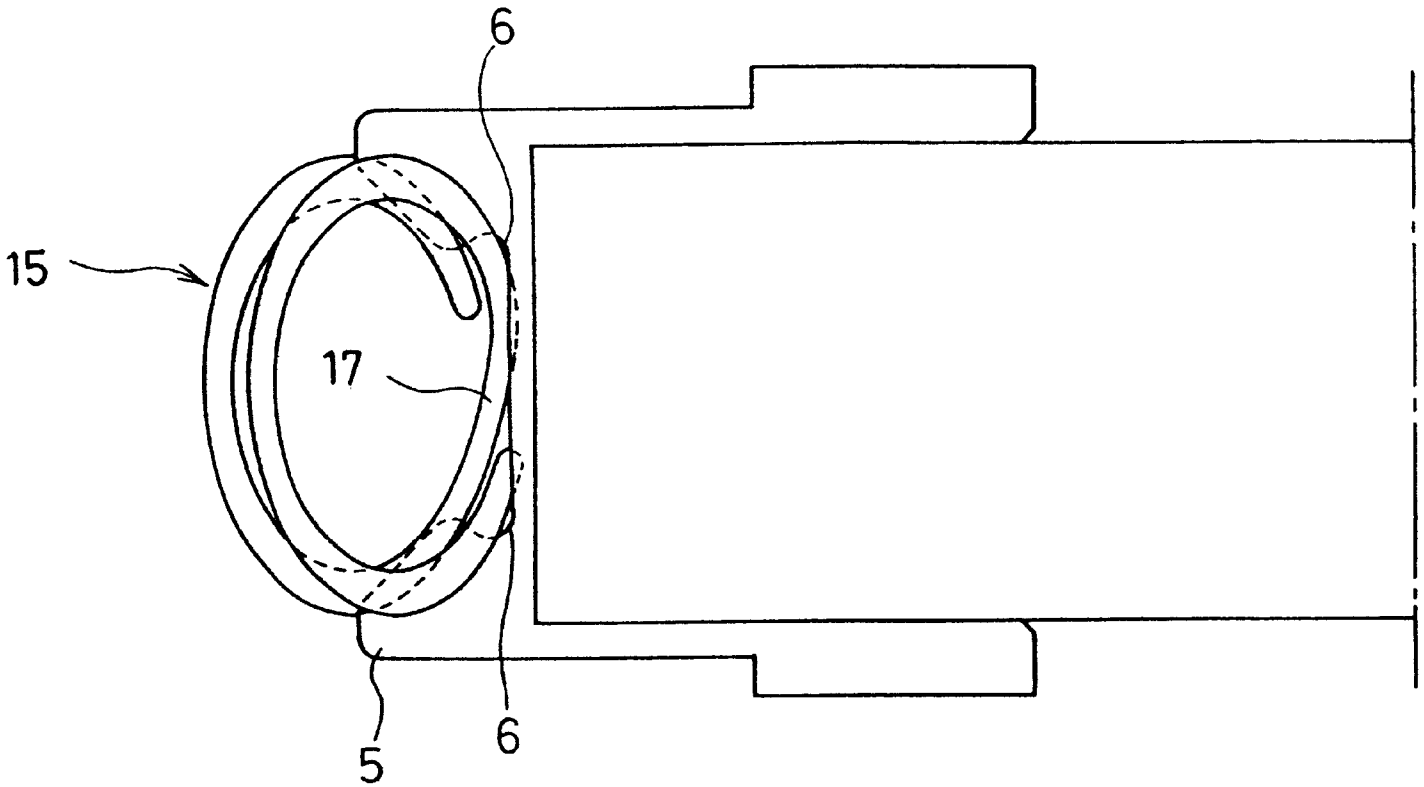
FIG. 5 is a top view showing the configuration of the latch apparatus of Embodiment 2 of the present invention.
Figure 6:
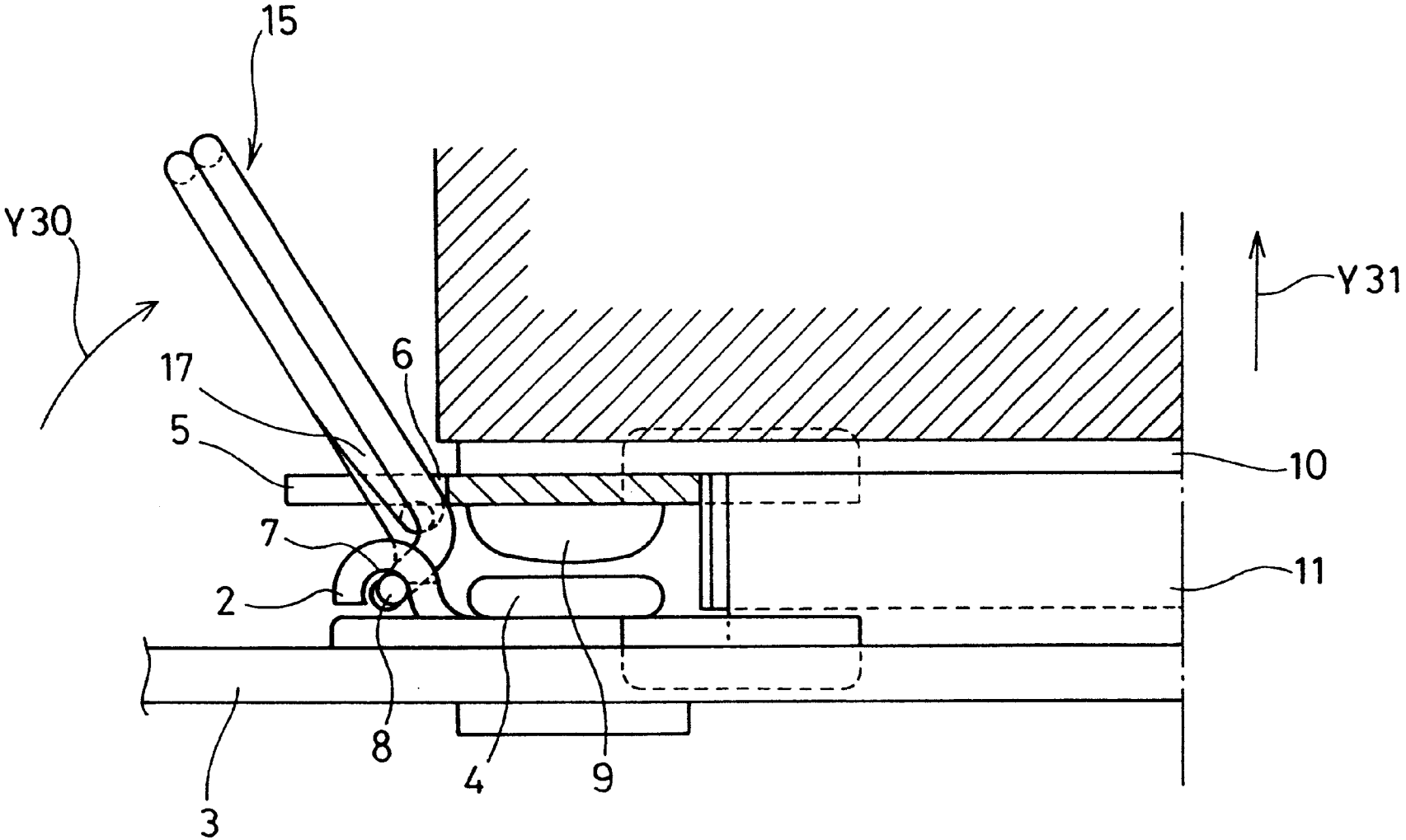
FIG. 6 is a side view showing the configuration of the latch apparatus of Embodiment 2 of the present invention.
Figure 7A:
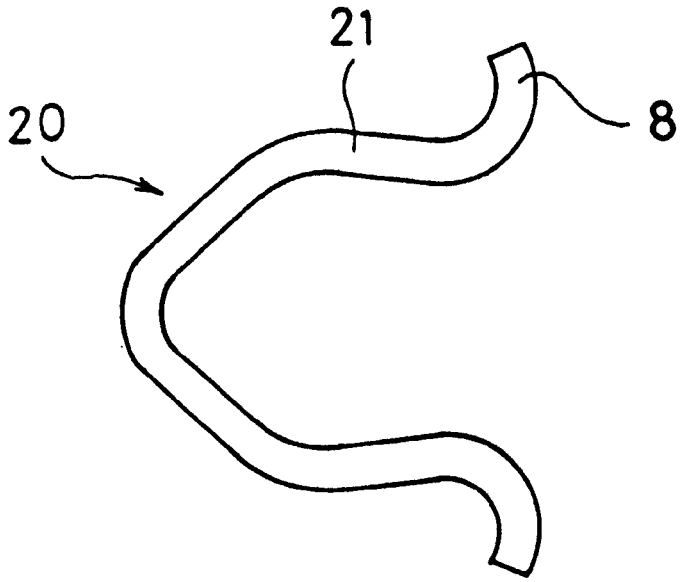
FIG.7a PRIOR ART
FIGS. 7*a*, 7*b* respectively illustrate front and side views of the structural drawing of a conventional latch spring in a conventional latch apparatus.
Figure 7B:
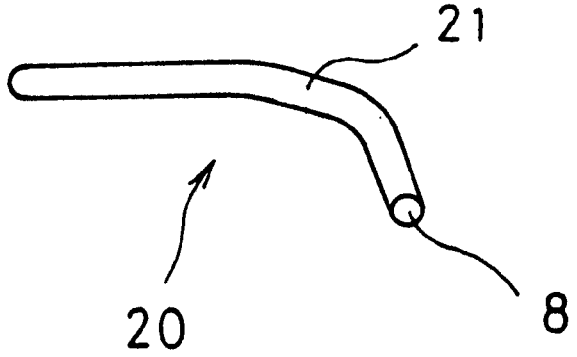
FIG.7b PRIOR ART
Figure 8A:
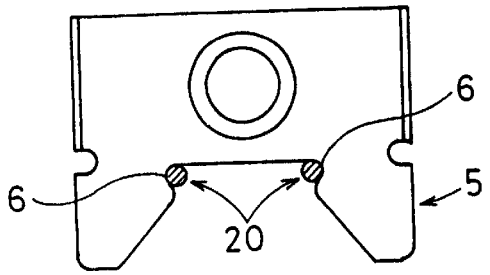
FIG. 8a PRIOR ART
FIGS. 8*a*, 8*b*, 8*c* respectively illustrate top, front and side views explaining the operation of the conventional latch apparatus.
Figure 8B:
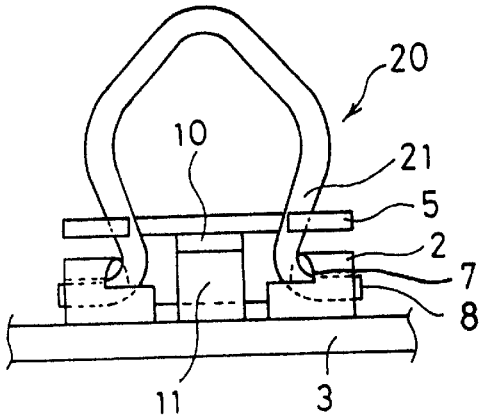
FIG. 8b PRIOR ART
Figure 8C:
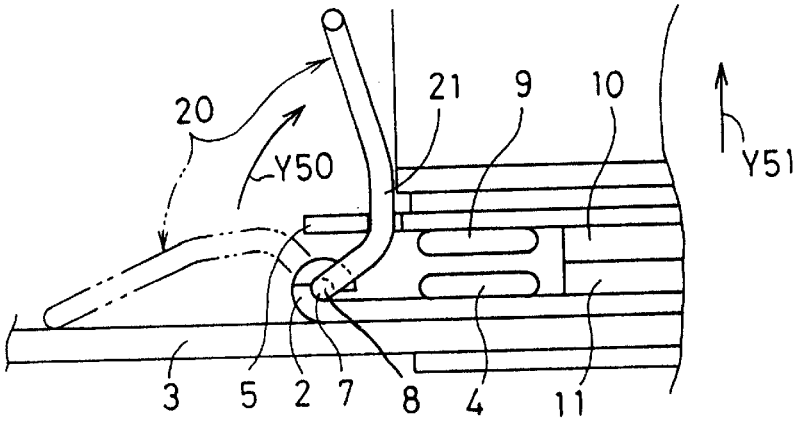
FIG. 8c PRIOR ART

FIG. 4 is a front view of a latch apparatus of the present Embodiment 2, FIG. 5 is a top view in the present Embodiment 2, and FIG. 6 is a side view in the present Embodiment 2.

As shown in these figures, a coiled latch spring 15 has a ring 17 which is a winding portion having one or more windings (in the present embodiment, illustratively the number of windings is a little less than two). The ring 17 is arranged approximately in accordance with the position of an engaging object with which the ring 17 is engaged and the coiled latch spring 15 is freely turnable in the state where both ends under the ring 17 are supported.

Furthermore, in each figure, a spring leg holder 2 is a support member to which a first connector 11 is provided and which supports the coiled latch spring 15 by pivotally engaging spring legs 8 as support portions of both ends thereof. A spring holder 5 is a holding member which is an engaging object of the coiled latch spring 15 and to which a second connector 10 is provided and which is brought into contact with and engaged with the ring 17 of the coiled latch spring 15 to hold the coiled latch spring 15.

If the coiled latch spring 15 is turned in the direction shown by the arrow Y30 around the spring leg holder 2 and the ring 17 of the coiled latch spring 15 is brought into contact with and engaged with the spring holder 5 to hold the coiled latch spring 15 by the spring holder 5, then the first connector 11 and the second connector 10 may be connected and fastened only by the coiled latch spring 15.

The operation of this latch apparatus will now be described below.

The coiled latch spring 15 is engaged by fitting the spring legs 8 into axial holes 7 of the spring leg holder 2, and the spring leg holder 2 is fastened to a mounting base 3 by a screw 4. Alternatively, the spring holder 5 is fastened to the second connector 10 by a screw 9.

The second connector 10 is engaged with the first connector 11 of the mounting base 3, and at this moment, the coiled latch spring 15 is turned in the direction shown by the arrow Y30 around the spring leg holder 2, and the coiled latch spring 15 contacts and engages a holder groove 6 of the spring holder 5. Consequently, and consequently, the connection and engagement between the first and second connectors 11, 10 are made sure. In other words, the second connector 10 is prevented from slipping off the first connector 11 by holding the spring holder 5 by the peripheral portion of the ring 17 of the coiled latch spring 15.

As mentioned above, when the coiled latch spring 15 is turned around the spring leg holder 2, the ring 17 of the coiled latch spring 15 contacts and engages the spring holder 5, and the coiled latch spring 15 is held by the spring holder 5, and the first connector 11 on the computer side and the second connector 10 on the cable side are connected and fastened only by the coiled latch spring 15. Consequently, the first connector 11 and the second connector 10 can easily and surely be engaged and fastened only by the coiled latch spring 15.

Accordingly, the spring holder 5 can hold the ring 17 of the coiled latch spring 15, and in the meantime, by the latching function for the spring holder 5 by the holding effect of the ring 17 formed to the coiled latch spring 15, the holding effect in the direction of slipping off from the first connector 11 (direction shown by the arrow Y31) can also be obtained for the second connector 10.

Therefore, the second connector 10 on the spring holder 5 side (cable side) can surely be connected and fastened to the first connector 11 on the spring leg holder 2 side (computer side), and it can be made impossible for the connectors 10, 11 to easily slip off between them and it can be made difficult for them to be separated, by a simple configuration, when compared with the shape of a conventional latch spring 20.

What is claimed is:

1. A latch apparatus for connecting and securing devices in a computer system comprising:

an elastic body, having an approximate omega (Ω) shape, the elastic body comprising a pair of spring legs, one spring leg at each end of the elastic body, and a pair of knuckles, the knuckles projecting in a direction approximately perpendicular to the plane of the omega (Ω) shape, and the knuckles located approximately linearly symmetrically;

a support member, the pair of spring legs pivotally attached to the support member;

a first securing member, attached to the support member;

a second securing member; and a holding member, attached to the second securing member, the holding member defining a holder groove, wherein the pair of knuckles are positioned in the holder groove when the first and second securing members are attached only by the elastic body.

2. A latch apparatus for connecting and securing devices in a computer system comprising:

an elastic body, the elastic body comprising a pair of spring legs, one spring leg at each end of the elastic body, and a winding, the winding located between the pair of spring legs, and the winding forming a coil parallel to the turning axis of the elastic body;

a support member, the pair of spring legs being pivotally attached to the support member;

a first securing member attached to the support member;

a second securing member; and a holding member, attached to the second securing member and the holding member defining a holder groove, wherein the winding abuts an edge of the holder groove when the first and second securing members are attached only by the elastic body.

3. The latch apparatus of claim 2, wherein the winding portion is positioned in the direction the elastic body is turnable to connect the first and second securing members, the coil thereby abutting the distal edges of the holder groove when the first and second securing members are attached only by the elastic body.

* * * * *